United States Patent [19]

Leboutet et al.

[11] Patent Number: 4,617,494

[45] Date of Patent: Oct. 14, 1986

[54] ELECTRON GUN FOR A LINEAR ACCELERATOR AND ACCELERATING STRUCTURE INCORPORATING SUCH A GUN

[75] Inventors: Hubert P. Leboutet, St. Cloud; Jeanne J. Aucouturier, L'Hay-Les-Roses, both of France

[73] Assignee: CGR-MEV, Buc, France

[21] Appl. No.: 562,442

[22] Filed: Dec. 16, 1983

[30] Foreign Application Priority Data

Dec. 21, 1982 [FR] France ..... 82 21399

[51] Int. Cl.[4] ..... H01J 25/10

[52] U.S. Cl. ..... 315/5.41; 315/5.42; 315/5.29; 332/7; 332/58

[58] Field of Search ..... 315/5.41, 5.42, 5.37, 315/5.29, 39; 332/7, 13, 58

[56] References Cited

U.S. PATENT DOCUMENTS

| | | | |
|---|---|---|---|
| 2,278,210 | 3/1942 | Morton | 315/39 X |
| 2,792,520 | 5/1957 | McArthur | 315/5.37 |
| 2,857,480 | 10/1958 | Mihran et al. | 330/45 |
| 3,061,791 | 10/1962 | Zaleski | 332/7 X |
| 4,425,529 | 1/1984 | Leboutet | 315/5.41 |
| 4,527,091 | 7/1985 | Preist | 315/39 |

*Primary Examiner*—Saxfield Chatmon
*Attorney, Agent, or Firm*—Roland Plottel

[57] ABSTRACT

The invention relates to an electron gun for a linear accelerator, able to supply a modulated electronic current for injection into an accelerating structure. Such an electron gun comprises a cavity resonator in which a cathode and a grid define a grid—cathode space, on which is closed said cavity resonator. An electromagnetic wave injected into said cavity resonator defines, with the grid and the cathode, an alternating potential difference by which the electronic current is modulated. The invention more particularly applies to industrial irradiation machines.

6 Claims, 3 Drawing Figures

ELECTRON GUN FOR A LINEAR ACCELERATOR AND ACCELERATING STRUCTURE INCORPORATING SUCH A GUN

BACKGROUND OF THE INVENTION

The invention relates to an electron gun for a linear accelerator, which makes it possible to modulate the electronic current as soon as it is formed. It also relates to an accelerating structure equipped with such an electron gun.

Electron guns, e.g. of the triode type, are used for generating electrons injected into an accelerating structure of a linear accelerator. An electromagnetic wave of an appropriate frequency for the accelerating structure makes it possible to accelerate these electrons and produce a beam, whose characteristics vary as a function of its application.

These applications are varied and linear accelerators are used for scientific purposes or for forming irradiators intended for use in therapeutic treatment and even more frequently for forming industrially used irradiation machines. These industrial irradiation machines e.g. make it possible to sterilize various products and can generally produce electron beams having energy levels between 1 and 10 MeV.

The electrical power consumed by these machines is considerable and can e.g. reach 130 Kw, of which only 20 Kw is in the accelerated electron beam. In addition, the overall efficiency of such a machine has significant direct repercussions on the cost of treating the products. Bearing in mind the industrial nature of these operations, and the importance of the electric power consumed, an improvement in this efficiency has very favourable economic consequences.

It is known to group electrons into clusters by means of so-called bunchers located on the path of the electrons, the bunchers being positioned between the electron gun and the accelerating structure into which these clusters are injected. Generally, the electronic current supplied by the gun is established in a continuous manner, during a given, repetitive operating time. The electrons constituting this current are grouped by these bunchers into clusters having a given duration and period by the operating characteristics of said bunchers.

Such a grouping of electrons into clusters may make it possible to improve the efficiency of a linear accelerator, to the extent that it obviates the consumption of the energy carried by the electromagnetic wave for electrons located outside of the range of the in phase acceptance of the accelerator, but it is difficult and complicated to realize such bunchers.

In the present invention, an improvement to the overall efficiency of a machine using an accelerating structure is obtained by means of a modulation of the electronic current, effected as soon as the latter is generated by the electron gun. For example, this modulation makes it possible to obtain clusters of electrons injected into the accelerating structure, without requiring bunchers for this purpose.

Electron guns for linear accelerators are frequenty constituted by a thermionic cathode and an anode, between which a grid controls the electronic current, as a function of a potential difference established between the grid and the cathode. This potential difference can be continuous for determining an operating time, in the manner explained hereinbefore, or within this operating time can have variations at high frequencies or brief transience. In the latter case, it constitutes a signal, which is generally processed by a complex injection modulator and carried by a transmission line having appropriate characteristics. However, the establishment of this signal between the grid and the cathode relative to the signal processed by the injection modulator causes difficulties, more particularly as a result of stray capacitances.

SUMMARY OF THE INVENTION

The present invention relates to an electron gun for a linear accelerator, able to produce a modulated electronic current. It avoids the use of a complex injection modulator and facilitates the establishment of an alternating potential difference between the grid and the cathode. It also relates to an accelerating structure of a linear electron accelerator, equipped with a gun according to the invention, making it possible to improve the overall efficiency of a machine using such an accelerating structure.

The present invention specifically relates to an electron gun for a linear accelerator, incorporating a cathode able to generate an electronic current, a grid able to control said current, an anode perforated by a hole centered around an axis, along which are emitted electrons, wherein it also comprises a cavity resonator closed on a cathode-grid space, said cavity resonator containing an electromagnetic coupling member connected to a transmission line and making it possible to inject an electromagnetic current of frequency F into said cavity resonator, in order to resonate the latter and excite the grid-cathode space, so as to determine between the grid and the cathode, an alternating potential difference of frequency F by which is modulated the electronic current.

The electromagnetic wave used for modulating the electronic current generated by such an electron gun can be sampled and injected into the cavity resonator of the gun either from a special generator used for this purpose, or from a generator used for supplying an electromagnetic wave injected into an accelerating structure, or by sampling the latter electromagnetic wave in an accelerating cavity of said structure and particularly in an accelerating cavity which is closest to the gun.

BRIEF DESCRIPTION OF THE DRAWINGS

The invention is described in greater detail hereinafter relative to the drawings, wherein show.

DESCRIPTION OF THE PREFERRED EMBODIMENTS

Figure 1:
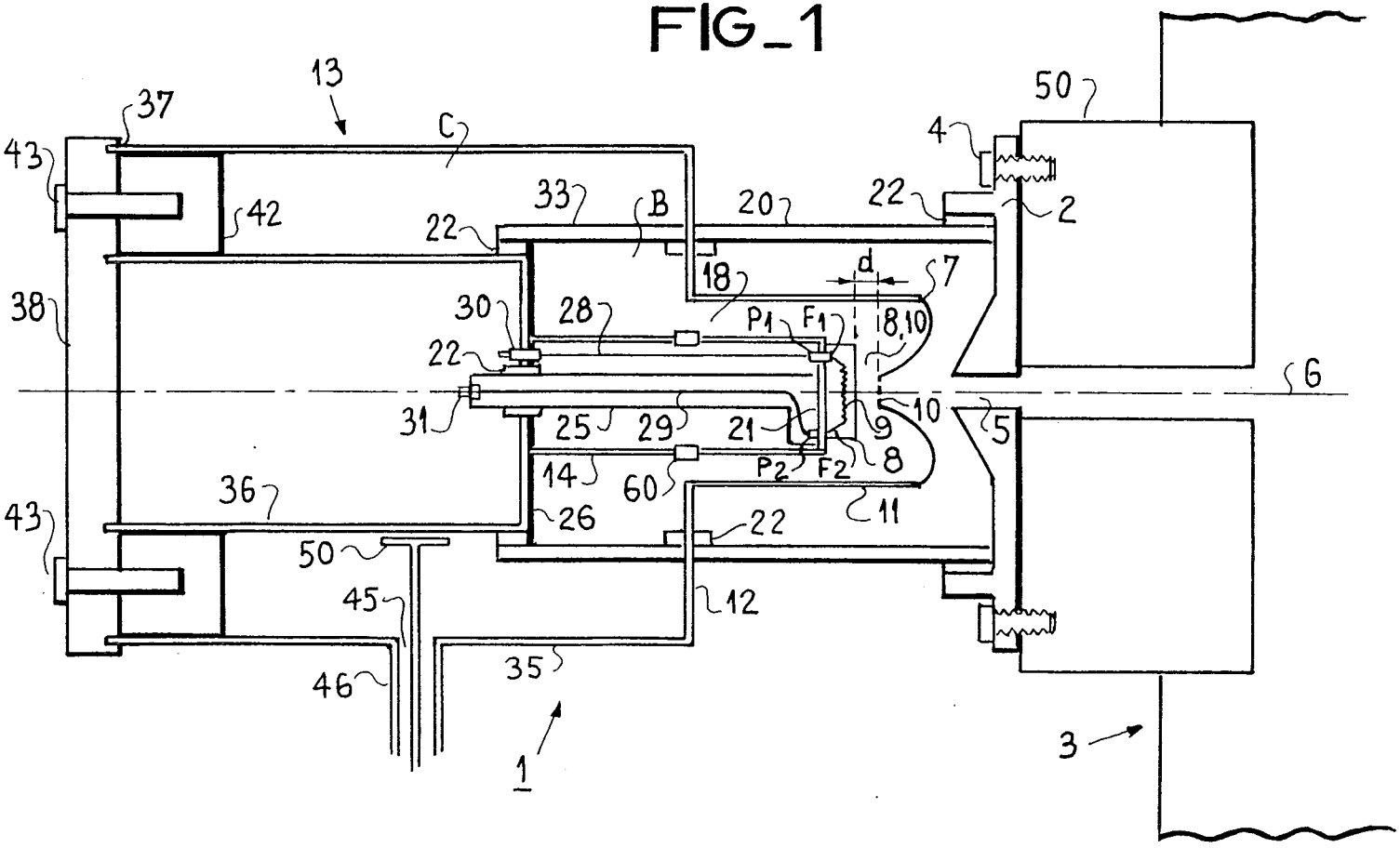
FIG. 1 a diagrammatic sectional view of an electron gun according to the invention.

FIG. 1 shows an electron gun 1 according to the invention. Gun 1 comprises an anode 2 in the present non-limitative embodiment, said anode is fixed by screws 4 to an element 50 of a partly shown accelerating structure 3. A hole 5 in anode 2 for the passage of electrons is centred on an axis 6, along which the electrons emitted by a cathode 8 are attracted by anode 2. Cathode 8 has a filament 9 and the electrons attracted by anode 2 traverse the plane of a grid 10 for controlling the passage of the electrons. Grid 10 is secured by a metal supporting tube 11, centred around the emission axis 6. Supporting tube 11 constitutes an extension of a coaxial cavity 13, which is itself centred around the emission axis 6. Supporting tube 11 is fixed to a first transverse wall 12 of cavity 13, e.g. by welding. An inner metal tube 14, also centred around the emission axis 6, is fixed to a second transverse wall 26 within the cavity 13. Thus, the latter is linked with a supplementary space 18 defined by grid 10, supporting tube 11 and inner metal tube 14, with which resonator 13 constitutes a coaxial cavity 13–18.

Cavity resonator 13–18, arranged along a longitudinal axis coinciding with emission axis 6, is thus bounded at one end 7 by grid 10, cathode 8 being at a distance d from the grid, which constitutes a cathode - grid space 8–10 on which, in operation, is closed the cavity resonator 13–18.

An e.g. ceramic electrical insulating tube 20 surrounds the supporting tube 11, in order to maintain the vacuum necessary for the operation of gun 1, by means of sealing means 22. Means used for the fixing of insulating tube 20 and the sealing means 22 are of a conventional nature and are not shown.

Cathode 8 is joined in a conventional manner to a plate 21, which has first and second contact studs $P_1$, $P_2$, to which are respectively connected ends $F_1$, $F_2$ of filament 9. For example, cathode 8 is also connected to the second contact stud $P_2$. The circular plate 21 is fitted into the inner metal tube 14 and is supported by a central insulating pin 25. The latter is fixed to the inner metal transverse wall 26 of cavity resonator 13 in a conventional manner by not shown means which, through the sealing means 22, make it possible to maintain the vacuum. A first electrical connection 28 connects the first contact stud $P_1$ to a tight bushing 30, whilst a second electrical connection 29 positioned axially within the central pin 25 connects the second contact stud $P_2$ to a second tight bushing 31. These tight bushings constitute connection means permitting the supply of filament 9 and the electrical access to cathode 8. In order to permit electrical insulation between cathode 8 and grid 10, the metal inner tube 14 has an insulating ring 60. High and low voltage are supplied to electron gun 1 in a conventional manner, so that the circuits required for this operation and any means required for cooling gun 1 are not shown.

In the present non-limitative embodiment, the cavity 13 also contains a second insulating tube 33, positioned in the extension of the first tube 20 and making it possible to ensure vacuum sealing by sealing means 22. This is brought about in order to avoid the establishment of the vacuum in the complete cavity resonator 13–18, which e.g. has a first part B under vacuum and a second part C at atmospheric pressure. This arrangement facilitates the installation of a regulating piston 42 and an electromagnetic coupling means 50, which will be explained in greater detail hereinafter.

Cavity 13 is formed by a first and a second metal tube 35, 36, coaxial to the emission axis 6 and respectively constituting an outer wall and an inner wall of cavity 13. Outer wall 35 is joined to the first transverse wall 12 and inner wall 36 is joined to the second inner transverse wall 26. A rear end 37 of cavity 13 has a base plate 38, which is more particularly used for maintaining the inner and outer walls 36, 35.

Cavity 13 also has a metal ring 42, contained between the inner and outer walls 36, 35, whereby said ring can be displaced parallel to the emission axis 6, by the action of a screw 43 integral with base plate 38. This metal ring constitutes the aforementioned regulating means 42, which makes it possible to modify the dimensions of the cavity resonator 13–18 and also to adjust in operation the resonant frequency of the latter. In operation, the rear end 37 of cavity resonator 13–18 is closed by a short-circuit. It is pointed out that as piston 42 is in part C, which is not subject to the vacuum, it does not cause sealing problems.

Outer wall 35 has a passage 45, to which is applied a transmission line 46. In the present embodiment, said transmission line is a coaxial line, whereof one end enters the cavity 13 and is provided with an electromagnetic coupling means 50. In this embodiment, the coupling means 50 is located in part C not subject to the vacuum of cavity resonator 13–18, in order to facilitate the connection of transmission line 46.

It is assumed that the following operating conditions have been for example realized:

- application of a heating voltage of filament 9;
- application of high voltage between cathode 8 and anode 2, whereby the anode can e.g. at earth and the cathode at a less high voltage;
- possible application of a polarization voltage between cathode 8 and grid 10;
- finally injection into the cavity resonator 13–18 of an electromagnetic wave supplied by transmission line 46 by means of the electromagnetic coupling member 50, whereby said electromagnetic wave which is generated by a generator not shown in FIG. 1, has a frequency F equal to the resonant frequency of resonator 13–18, or is a multiple of said frequency.

Not shown electrical and magnetic fields at frequency F are then developed in a conventional manner in the cavity resonator 13–18 and excite the grid - cathode space 10–8, which determines an alternating potential difference of frequency F between grid 10 and cathode 8.

This alternating potential difference or alternating voltage, is superimposed on the polarization voltage, thus permitting a not shown modulation of the electronic current. The electronic current supplied by gun 1 can consequently be more or less deeply modulated, as a function of the sought objective. The modulation depth or the modulation type is particuarly obtained as a function of the level of the polarization between grid 10 and cathode 8, the level of the electromagnetic wave injected into cavity resonator 13–18 and as a function of the distance d between grid 10 and cathode 8.

This constitutes a non-limitative embodiment of an electron gun 1 according to the invention, but both cavity 13 and coupling member 50 can be in a different form. The latter can also be constituted by a not shown coupling loop, rather than by capacitive coupling as shown in FIG. 1. In addition, it is also possible to conceive a different struture for supporting cathode 8 and plate 21, as well as for supplying power to filament 9.

As stated hereinbefore, an electromagnetic wave of frequency F and appropriate for an accelerating structure into which it is injected, makes it possible to accelerate electrons, and, after traversing said structure, the electrons constitute an accelerated electron beam of given energy.

An accelerating structure is generally constituted by a succession of n accelerating cavities. In order to once again use the example of an industrial irradiator, said accelerating cavity can be of the type described in French Patent Application No. 2 477 827 of the present Applicant.

Figure 2:
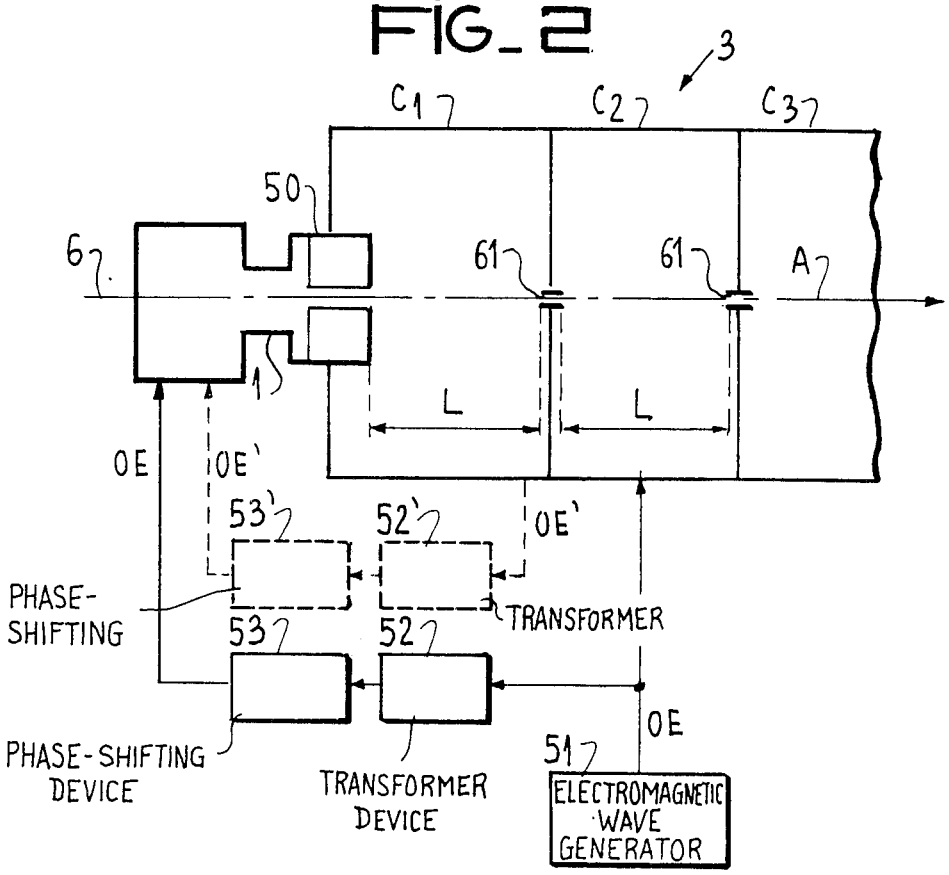
FIG. 2 an electron gun according to the invention associated with an accelerating structure and coupled to an electromagnetic wave generator.

FIG. 2 diagrammatically shows in the form of a non-limitative embodiment, an accelerating structure 3 having such accelerating cavities $C_1$, $C_2$, $C_3$. A single accelerating cavity $C_1$ may be sufficient in certain cases. Electrons supplied by gun 1 according to the invention are injected in a conventional manner into accelerating structure 3 using a sliding and focusing member 50.

The electrons are accelerated in accelerating structure 3 in a mean direction A, coinciding with the emission axis 6 of the electrons generated by gun 1, by means of an electromagnetic wave O.E. of frequency F supplied by generator 51. This wave is injected into the accelerating structure 3, e.g. into accelerating cavity $C_2$, by conventional, not shown coupling means, as well as coupling means between the cavity resonators $C_1$, $C_2$, $C_3$.

In the present non-limitative embodiment, the electromagnetic wave O.E. at frequency F is also injected into gun 1, via a transformer means 52 and a regulatable phase shifter means 53. It is consequently possible to inject into gun 1, the electromagnetic wave O.E. of frequency F generated by generator 51, with a phase adjustable relative to that of the wave injected into cavity $C_2$. This arrangement makes it possible to modulate the electronic current supplied by gun 1 at the same frequency F as that injected into the accelerating structure 3 for the acceleration of electrons.

For practical reasons, it may also be of interest to sample the electromagnetic waves in the accelerating structure 3, e.g. in the first accelerating cavity $C_1$, in view of its proximity to gun 1. This variant is shown in dotted line form in FIG. 2. The electromagnetic wave O.E.' is injected into gun 1 via a transformer 52' and a phase shifter 53'.

In general, electrons injected into the first accelerating cavity $C_1$ aquire a speed close to that of light, if the phase of the electromagnetic wave O.E. is favourable thereto. The time during which the energy carried by this wave is transferred to the electrons is at the maximum equal to a half-period or half-cycle of said wave. In addition, in order to prevent a reduction in the energy of the electrons, a length L traversed by the latter in each cavity $C_1$, $C_2$, $C_3$ is less than a half-period of a wave. A sliding space 61 between each cavity enables the electrons to recover a correct wave phase on entering the following cavity.

Figure 3:
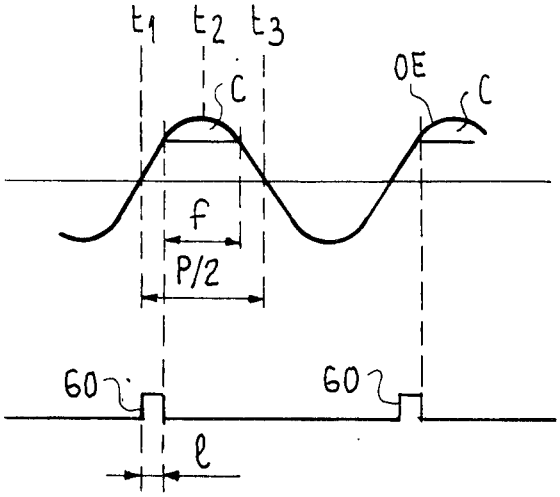
FIG. 3 correlations of phases between the modulated electronic current and the electromagnetic wave injected into the accelerating structure.

On assuming that the electrons reach a cavity $C_1$ as from a time $t_1$, as shown in FIG. 3, time $t_1$ corresponding to the start of an accelerating half-period P/2 of the electromagnetic wave O.E., the energy transferred to the electrons at time $t_1$ is zero and increases up to time $t_2$ corresponding to the maximum of the wave peak c and then decreases to time $t_3$ corresponding to the end of half-period P/2. This gives the electrons different energy levels as a function of their entry into said cavity during the time interval between $t_1$ and $t_3$, so that the thus obtained accelerated electron beam would be possibly homogeneous in energy.

It is also pointed out that weakly accelerated electrons tend to diverge from direction A and are then lost for the electron beam. Thus, although lost for the beam, these electrons have consumed a by no means negligible portion of the energy carried by electromagnetic wave O.E.

It is therefore of particular interest to control the electron beam 1 according to the invention in such a way as to obtain pulses 60 of the electronic current which it supplies. These pulses 60 constitute electron clusters, supplied at the same frequency f of that of the electromagnetic wave.

By in this way modulating the electron gun 1, so as to obtain pulses or clusters 60 of width 1 equal to or less than a half-period P/2, by means of the phase shifter 53, it is also possible to ensure that they coincide in each cavity $C_1$, $C_2$, $C_3$ with the peak of the accelerating half-period P/2. Thus, the electromagnetic wave O.E. transfers to the electrons, the energy carried by it during only a fraction f of the accelerating halfperiod P/2, at which said energy is at a maximum. This also prevents a consumption of said energy, in order to accelerate the electrons located outside the range of in phase acceptance of the accelerator.

Such an arrangement is applicable to any linear electron accelerating structure. It makes it possible to reduce the energy consumed in the electromagentic waves, whilst improving the energy homogeneity of the thus obtained accelerated electron beam.

What is claimed is:

1. A linear accelerator device comprising an electron gun, an accelerating structure, and means for providing an electromagnetic wave; said gun comprising a cathode able to generate an electronic current, a grid able to control said current, and anode perforated by a hole centered around an axis along which are emitted electrons, a cavity resonator closed on a cathode-grid space, said cavity resonator containing an electromagnetic coupling member connectd to a transmission line and making it possible to inject an electromagnetic wave of frequency F into said cavity resonator in order to resonate the latter and excite the cathode-grid space so as to determine between the grid and the cathode, an alternating potential difference of frequency F by which is modulated the electronic current; said accelerating structure comprising at least one accelerating cavity connected to said electron gun for receiving therefrom said electron current, means for injecting into said accelerating cavity an electromagnetic wave at said frequency F, said frequency F being the same as the frequency F injected into said cavity resonator of said electron gun and phase shifting means for controlling the phase of the electromagnetic wave injected into the cavity resonator of the electron gun and the electromagnetic wave injected into the accelerating cavity of the accelerating structure; whereby the electrons from the gun are emitted in pulses or clusters which coincide in said accelerating cavity with an accelerating half-period of said electromagnetic wave for accelerating said electrons.

2. A device according to claim 1 wherein said electromagnetic waves of frequency F are provided by a common electromagnetic source.

3. A device according to claim 2 wherein said accelerating structure comprises first and second accelerating cavities and wherein electromagnetic waves in said first cavity closest to the gun are sampled and said sample wave is injected into said gun.

4. A device according to claim 1 wherein said pulses or clusters are of a width equal to or less than a half-period P/2 of the electromagnetic wave and said electron gun is modulated so that said pulses or clusters coincide in each cavity of said accelerating structure with the peak of the accelerating half wave period P/2, whereby the electromagnetic wave transfers to the electrons in each cavity the energy carried by the wave during only a fraction of the accelerating half period P/2 at which said energy is at a maximum.

5. A device comprising an electron gun generating an electron beam, and an accelerating structure comprising at least one accelerating cavity connected to said gun for receiving said beam; said gun comprising a cathode able to generate an electronic current, a grid able to control said current, an anode perforated by a hole centered around an axis, along which are emitted electrons, wherein it also comprises a cavity resonator closed on a cathode-grid space, said cavity resonator containing an electromagnetic coupling member connected to a transmission line and making it possible to inject an electromagnetic current of frequency F into said cavity resonator, in order to resonate the latter and excite the grid-cathode space, as as to determine between the grid and the cathode, an alternating potential difference of frequency F by which is modulated the electronic current, and forming said electrons leaving said gun into clusters or pulses at said frequency F, said frequency F being the same as that injected into the accelerating cavity of said accelerating structure for the acceleration of electrons and phase shifting means for controlling the phase of the electromagnetic wave injected into the cavity resonator of the electron gun and the electromagnetic wave injected into the accelerating cavity of the accelerating structure whereby the electrons emitted from the gun in pulses or clusters coincide in said accelerating cavity of the accelerating structure with an accelerating half-period of the electromagnetic wave driving the accelerating structure.

6. A linear accelerator comprising an electron gun, for providing a current of electrons, accelerating means supplied with the beam for accelerating the electrons in the beam, and means for supplying electromagnetic wave energy to the accelerator, the electron gun comprising a cathode able to emit a current of electrons, a grid able to control said current, a perforated anode for passage therethrough of the electrons, a cavity closed on the cathode-grid space resonant at a frequency F and including means by which it may be supplied with energy of frequency F, or a multiple of said frequency, to resonate the cavity and excite the cathode-grid space to establish between the grid and cathode an alternating potential for modulating the current of electrons and forming it into clusters of electrons, and the accelerating means comprising at least cavity proximate the electron gun for receiving therefrom said clusters of electrons, said cavity being resonant at the frequency F and including means by which it may be supplied with energy of frequency F, or a multiple thereof and phase shifting means for controlling the phase of the electromagnetic wave injected into the cavity resonator of the electron gun and the electromagnetic wave injected into the accelerating cavity of the accelerating structure, whereby the clusters of electrons may be accelerated.

* * * * *